United States Patent [19]

Rehmann

[11] Patent Number: 4,550,661

[45] Date of Patent: Nov. 5, 1985

[54] SAFETY DEVICE FOR AMMUNITION

[75] Inventor: Robert Rehmann, Neerach, Switzerland

[73] Assignee: Ems-Inventa AG, Switzerland

[21] Appl. No.: 532,200

[22] Filed: Sep. 14, 1983

Related U.S. Application Data

[63] Continuation-in-part of Ser. No. 355,877, Mar. 8, 1982, abandoned.

[30] Foreign Application Priority Data

Sep. 16, 1982 [CH] Switzerland ..... 5481/82

[51] Int. Cl.[4] ..... F42C 15/29

[52] U.S. Cl. ..... 102/251; 102/256

[58] Field of Search ..... 102/221, 222, 229, 231, 102/235, 237, 244, 247, 251, 254, 256, 255, 248, 249, 232, 233

[56] References Cited

U.S. PATENT DOCUMENTS

| | | | |
|---|---|---|---|
| 3,117,522 | 1/1964 | Hutchinson et al. | 102/235 |
| 3,921,531 | 11/1975 | Morrow | 102/251 |
| 3,956,991 | 5/1976 | Means et al. | 102/229 |
| 3,958,511 | 5/1976 | Morrow | 102/251 |
| 4,026,211 | 5/1977 | Ostling | 102/222 X |
| 4,128,061 | 12/1978 | Kaiser | 102/249 |

FOREIGN PATENT DOCUMENTS

| | | | |
|---|---|---|---|
| 1118060 | 11/1961 | Fed. Rep. of Germany | 102/249 |
| 1528313 | 4/1968 | France . | |

*Primary Examiner*—Harold J. Tudor

*Attorney, Agent, or Firm*—Jordan B. Bierman

[57] ABSTRACT

The invention is directed to the provision of a safety device to prevent premature detonation of ammunition, particularly low spin projectiles of the type in which a primer pellet is positioned in a rotor which rotates from an unarmed to an armed position upon firing. The safety device is biased under the action of the spring to project into a groove in the rotor so as to be engageable with an end face of the groove. If the projectile is fired with normal acceleration, the resulting force will cause the safety device to become disengaged from the groove in the rotor against the action of the spring. If acceleration is below normal, the safety device will engage the rotor and lock it in an unarmed position. An inertial mass lock is also provided as an additional measure against accidental or premature arming of the projectile. A retard mechanism delays rotation of the rotor to an armed position for a selected time period sufficient for the projectile to advance a safe distance from a gun or launcher before becoming armed.

10 Claims, 15 Drawing Figures

FIG.1
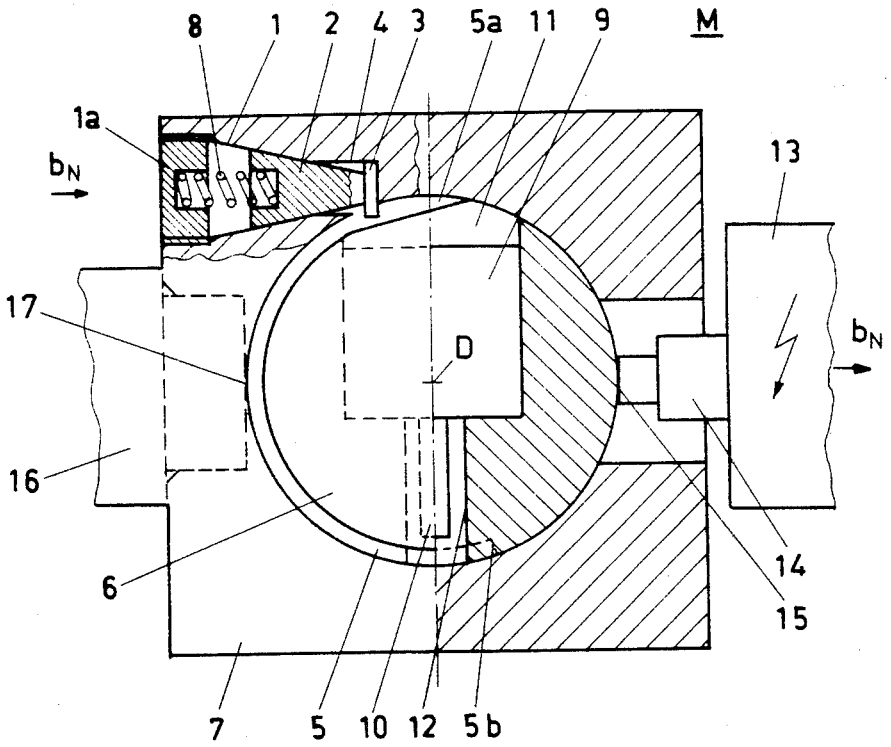
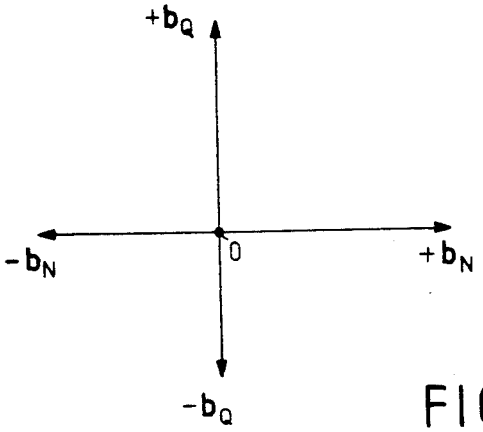
FIG.1a

FIG. 6
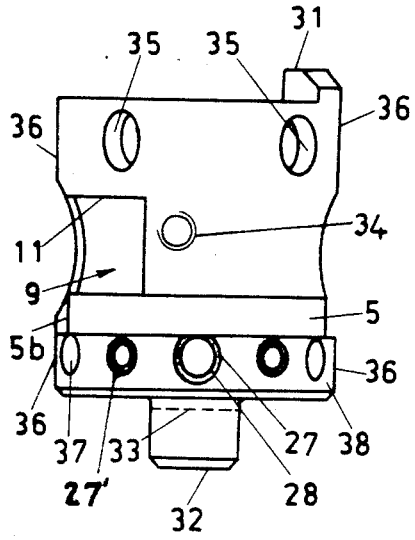
FIG. 7
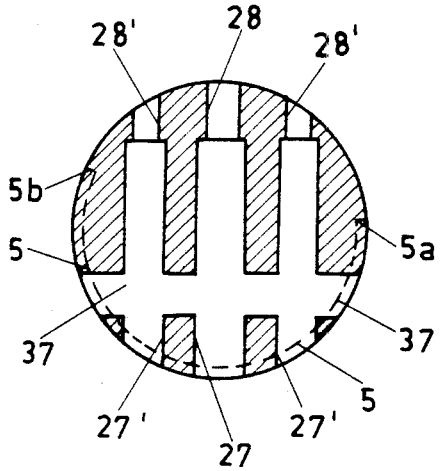
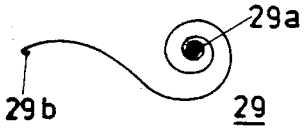
FIG. 8
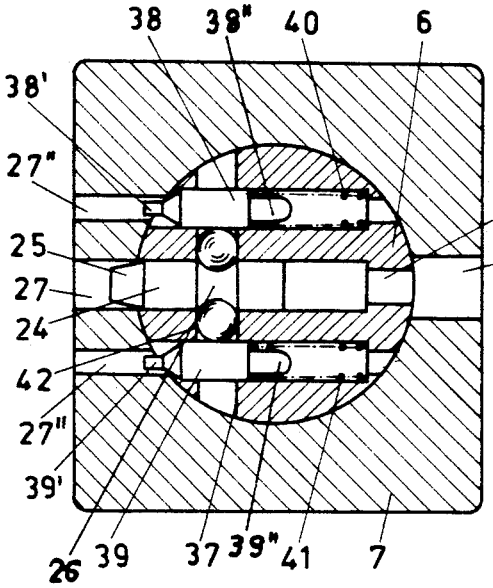
FIG. 9
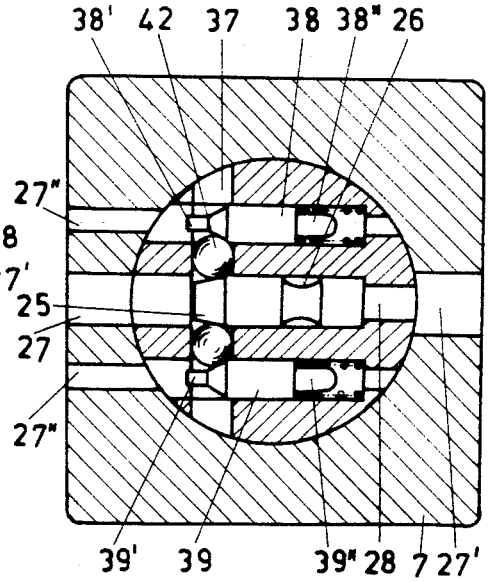
FIG. 10

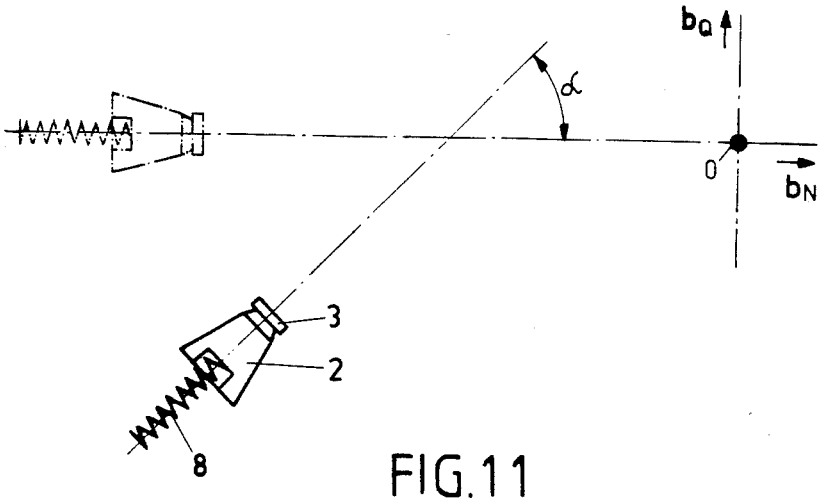
FIG.11
FIG.12
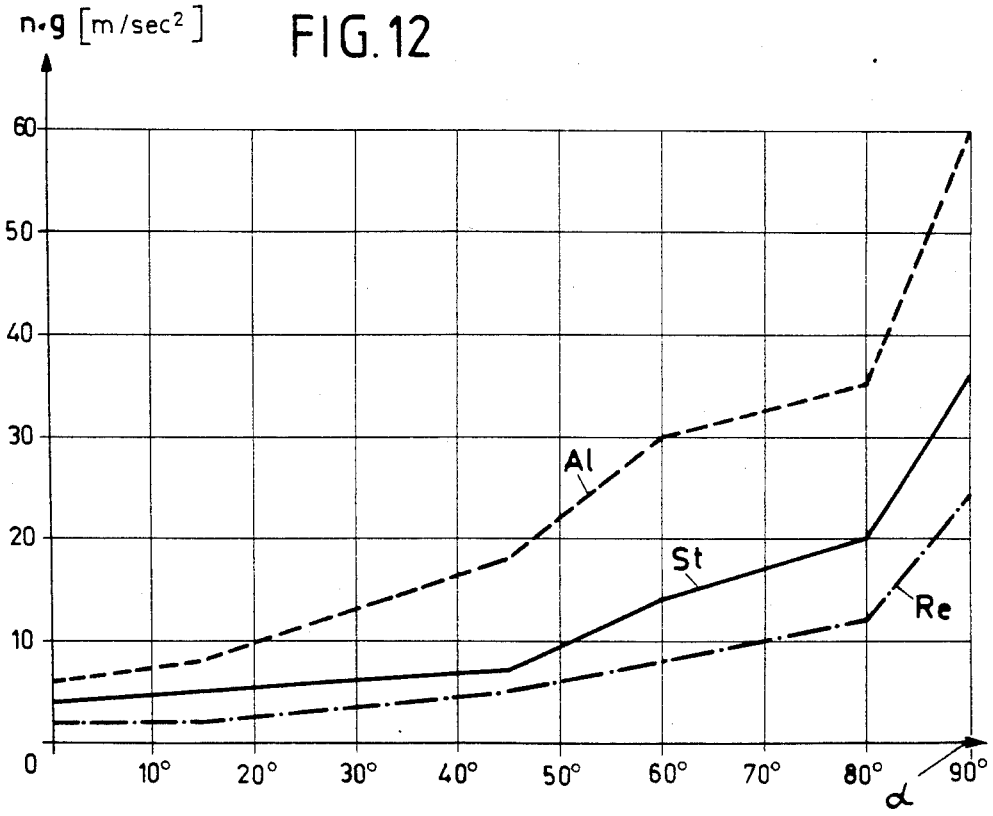

SAFETY DEVICE FOR AMMUNITION

This application claims the priority of Swiss Application 5481/82-9, filed Sept. 16, 1982, and is a continuation-in-part of U.S. application Ser. No. 355,877, filed Mar. 8, 1982, now abandoned, which is based upon the corresponding Swiss Application 5579/80, filed July 22, 1980.

BACKGROUND OF THE INVENTION

The present invention relates to a safety device for securing the primer pellet in ammunition in a locked position during non-firing conditions, and for releasing the primer pellet to an armed position under expected firing conditions.

The problem of securing ammunition such as projectiles, grenades, rockets, etc. is gaining in importance as new high performance explosives and weapon systems with increased ballistic efficiency are being developed. Also, the safety requirements have been increased. For example, the NATO MIL-STD (Military Standard) 1316B of Feb. 15, 1977 requires that at least two safety devices physically independent of each other must be provided in approved ammunition. This requirement has, until now, been difficult to fulfill, especially for projectiles with low spin. In practice, the second safety device has usually been omitted.

A known form of safety device has the primer mounted in a rotatable body or rotor with radial bores which are engaged by radial projections having a wedging effect. This safety combination insures that minor impacts during transportation will not cause unintentional detonation, and the unlocking of the primer to an armed position will occur only after the projectile has traversed a distance of about seven to fifteen meters from the mouth of the gun barrel. This known configuration is not considered to meet present safety requirements, since the arming of the primer occurs at too short a distance from the gun for safety.

It is therefore a principal object of the present invention to provide a secure, electrically ignited arming device for ammunition which insures a higher degree of safety than has been provided heretofore, and can be used particularly for projectiles with low spin when fired. It is a particular object to provide a safety device that will lock the primer in an unarmed position if the firing acceleration forces are below normal, and that will remain operative even under conditions of substantial transverse accelerations.

It is a further object of the invention to provide a safety device for ammunition which prevents unlocking of the primer to an armed position under non-firing conditions such as accidental impacts during transportation or if the flight of the projectile is abnormally interrupted. A broad object of the invention to provide an ammunition safety device that is simple, economical, compact, and of great mechanical stability.

SUMMARY OF THE INVENTION

A safety device for a primer pellet holder installed in ammunition has means for guiding the movement of the primer pellet holder from a locked to an armed position, and means for securing the primer pellet holder in a locked or unarmed position except in response to normal acceleration forces during firing. The locking arrangement includes a bore in the ammunition housing arranged approximately in line with the direction of acceleration, a bolt movable in the bore in the longitudinal direction and, preferably, at least partially movable in the transverse direction, biasing means normally urging the bolt in the direction of acceleration so as to extend into a groove formed in the primer pellet holder defining the unarmed position thereof, projecting means, preferably a flange, on the end of the bolt adapted to extend into said groove, and locking means on the end of the groove defined in the primer pellet holder for engaging said projecting flange of said bolt in the unarmed position.

The bolt is adapted to move against said biasing means out of said groove during conditions of normal firing acceleration, thereby permitting movement of said pellet holder to the armed position. Preferably, the bolt has a conical shape so as to be movable longitudinally and at least partly transversely in the corresponding, conical shaped bore, and the bore has a cylindrical zone forward of its conical zone for accomodating the movement of the projecting flange in the longitudinal direction during acceleration.

In one preferred embodiment of the invention, the primer pellet holder is a rotor having the groove formed on at least a part of its circumference. The projecting flange extends into the groove and is adapted to engage the locking means defined at an end of the groove. In another embodiment, the primer pellet holder is a slide movable transversely in a channel, and the bolt is oriented in the direction of acceleration or at an angle thereto.

Preferably, the safety device also includes an inertial mass release means for releasing the primer pellet holder for movement to the armed position upon firing, and a retard mechanism for delaying the movement of the primer pellet holder to the armed position for a predetermined safety period. The safety device of the invention permits reliable control of the movement of the primer pellet holder from the locked to the armed position in accordance with the conditions of normal acceleration upon firing, and therefore prevents unintended detonation of the round. Due to the bolt being movable transversely as well as longitudinally, transverse accelerations during firing of the round can be absorbed without the bolt becoming wedged and thereby having its functionality impaired.

DESCRIPTION OF THE DRAWINGS

In the accompanying drawings, constituting a part hereof and in which like reference characters indicate like parts, FIG. 1 is a cross-sectional side view of the safety device with the rotary primer pellet holder in a rest position;

FIG. 1*a* is a coordinate diagram illustrating the direction of acceleration;

FIG. 6 is a plan view of the rotary pellet holder of the safety device;

FIG. 7 is a cross-sectional side view of an inertial release mechanism used in conjunction with the rotary pellet holder;

FIG. 8 illustrates an arming spring used in conjuction with the rotary pellet holder;

FIG. 9 is a cross-sectional side view showing the release mechanism in the locked position prior to firing;

FIG. 10 shows the release mechanism in the unlocked position;

FIG. 11 depicts the coordinate relationship for the bolt of the locking device oriented at an angle to the direction of acceleration;

FIG. 12 illustrates the operative acceleration conditions for the bolt as shown in FIG. 11 for different angles of orientation and different materials;

DETAILED DESCRIPTION OF THE INVENTION

Figure 2:
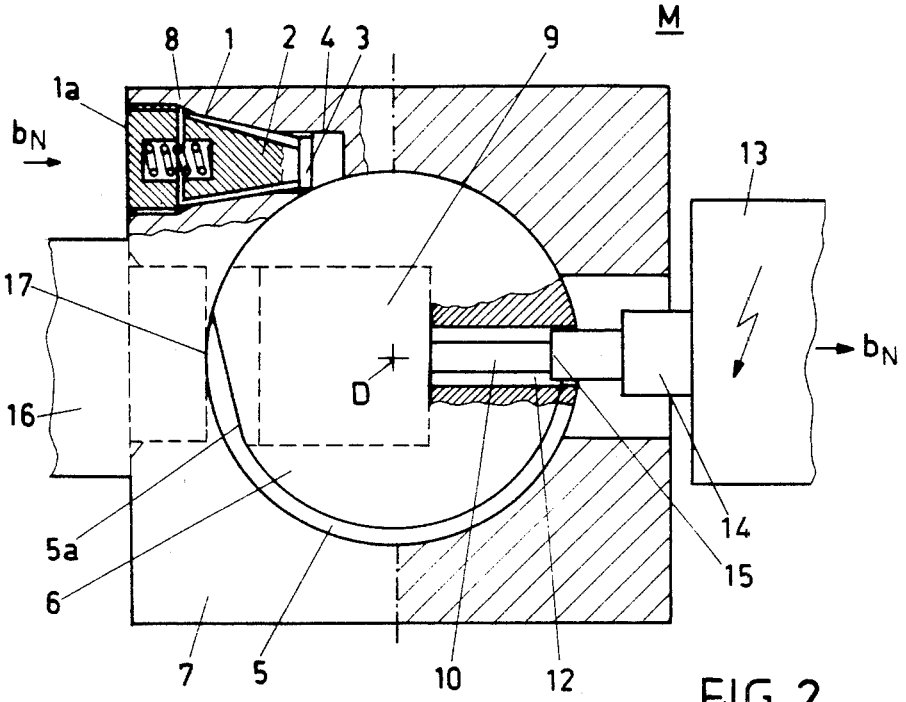
FIG. 2 is a view similar to FIG. 1 whereby the device is in the armed position after normal firing.
Figure 3:
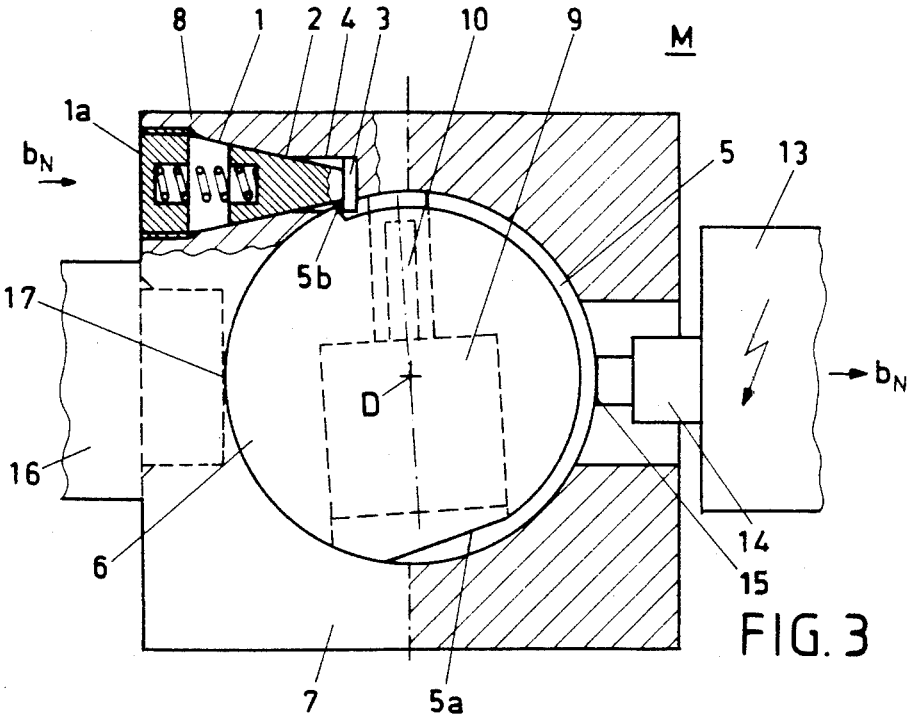
FIG. 3 is a view similar to FIG. 1 showing the locking of the safety device under abnormal or nonfiring conditions.

Referring to FIGS. 1 to 3, there is shown a preferred form of the safety device for use in an electrically primable projectile M to be fired at high acceleration in the direction $b_N$. Although one embodiment of the operative elements of the safety device is shown, it is to be understood that other forms may be used which will accomplish the purposes of the invention described herein.

Bore 1 in housing 7 of the projectile M is conically shaped over at least a portion of its length. Threaded ring 1*a* closes bore 1 and at the same time centers spring 8 which biases forward complementary conical bolt 2 having projecting flange 3 at its end face. Bore 1 has cylindrical part 4 to accomodate longitudinal movement (i.e. in the direction of main acceleration) of flange 3.

In the center of housing 7 is primer pellet holder 6, illustrated in the preferred embodiment as a rotor with pivot point D. Over a part of its circumference, the primer pellet holder 6 has groove 5, with terminating portion 5*a* at one end and locking face 5*b* at the other end. Inside pellet holder 6 is primer pellet 9 and an insulated pole pin 10 protruding therefrom. Pellet 9 is connected to holder 6 by mounting 11, and pole pin 10 is maintained in constricted bore 12 of holder 6.

At the end of the pellet holder 6 in the direction of main acceleration $b_N$, there is electrical charge generator 13, consisting of an ignition generator with a safety and storage circuit and a target sensor. Charge generator 13 has telescoping contact 14 which applies contact surface 15 to pellet holder 6. At the other end of pellet holder 6 is booster charge 16, initiation point 17 of which likewise projects into housing 7 toward holder 6.

The rectangular coordinate system shown in FIG. 1*a* indicates, in the positive part of the abscissa, the direction of the main acceleration $b_N$ of projectile M. The projectile is in this acceleration zone when being fired. After leaving the gun barrel or launch path, projectile M experiences a flow resistance, such that, after a certain flight duration, the positive acceleration values which previously were continuously increasing become, relatively speaking, negative values in the zone marked $-b_N$. Upon actual firing, the projectile experiences different angular positions on its ballistic trajectory, which result in components of transverse accelerations $b_Q$ (positive and negative).

When projectile M is fired on a ballistic trajectory, pellet holder 6, initially locked by an inertial mass lock (described in detail further herein), is unlocked by the acceleration forces and undergoes, from the starting position shown in FIG. 1, a clockwise rotation about pivot point D. These forces act also on conical bolt 2, whereby the latter is pushed, due to its mass, in the direction of threaded ring 1*a* and is thus pulled with its projecting flange 3 out of the groove 5, as shown in FIG. 2. When firing at normal firing accelerations, the forces are high enough for a sufficiently long time, so that bolt 2 is kept in the position shown in FIG. 2. The spring tension and the design and mass of the bolt are selected such that the bolt is driven back far enough under the expected normal firing conditions. This enables pellet holder 6 to rotate 270° in the given time, and reach the armed condition illustrated.

In the armed position, telescoping contact 14 of electrical charge generator 13 slides into bore 12 of pellet holder 6 and contacts pole pin 10. When the target sensor closes the circuit, the detonating charge is electrically ignited. The shock wave produced in the primer pellet 9 causes a detonation transmission at initiation point 17 of booster charge 16.

If the firing acceleration is below normal or expected conditions, or if the flight of the ammunition round is stopped prematurely, for example, by impinging on an obstacle, the acceleration forces acting on bolt 2 change, so that the bolt is pushed by spring 8 back into its end position in bore 1. Flange 3 then projects into groove 5 and acts to stop pellet holder 6 in its rotation by engagement of locking face 5*b* with projecting flange 3, as shown in FIG. 3. The projectile is thus inactivated and cannot be armed without re-acceleration. This safety device is also effective to prevent arming of the ammunition upon accidental movement of the rotor as, for example, during storage or handling, since the spring will maintain the bolt 2 in the safety position.

Figure 4:
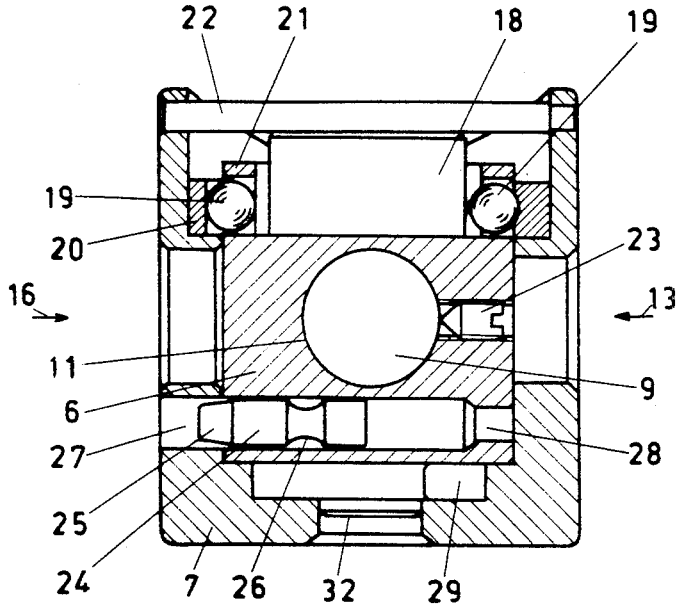
FIG. 4 is a cross-sectional plan view of the embodiment of FIGS. 1 through 3.

Further embodiments and features of the invention are described with reference to FIGS. 4 to 12. For reasons of clarity, electrical charge generator 13 and booster charge 16 are symbolized by arrows in FIGS. 4 and 5. In FIG. 4, a retarding mechanism for the safety device has balance wheel 18 surrounded by four balls 19, which are guided concentrically to wheel 18 by ball rim 20 and clamping ring 21. Retention pin 22 serves as a hold-down for this arrangement. Pellet holder 6 is shown with pellet 9 fixed in opening 11 by means of threaded pin 23.

As shown in FIGS. 4, 9 and 10, the safety device further comprises an initial release mechanism in the form of an inertial mass lock, having piston 24 slidably located in bore 27 in housing 7. Constricted bore 28 provides an opening for exchange of air into bore 27 and limits the slide path of piston 24 to the release position shown in FIG. 10 upon normal acceleration. Piston 24 has detent recesses into which balls 42 of the inertial mass lock shown in FIGS. 9 and 10 engage. Journal end 32 of the pellet holder has slit 33 (see FIG. 6) for securing an end of arming spring 29 (shown in FIG. 8) which biases the holder for clockwise rotation when the inertial mass lock is released.

Figure 5:
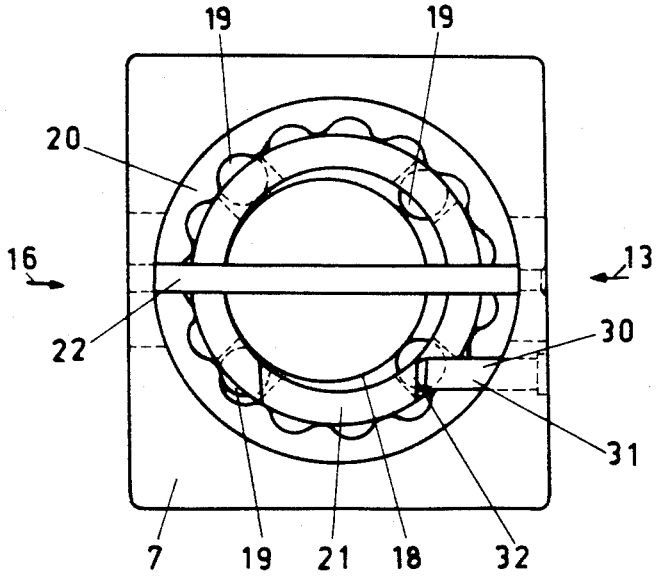
FIG. 5 is a side view taken from the opposite side of the embodiment of FIGS. 1 through 3 showing the retard mechanism.

In FIG. 5, a retard mechanism is provided for slowing rotation of the pellet holder for a selected safety delay period sufficient to allow the projectile to accelerate a safe distance beyond the gun barrel or launcher before it becomes armed. Stop pin 30 acts to limit the overall rotational path of the pellet holder by cam abutment 31. The pellet holder rotor, shown in detail in FIG. 6, is guided and centered in housing 7 by cylindrical portion 36 and has at one end cam abutment 31 and at its other end journal 32.

The pellet holder has an opening on one side for the uptake of primer pellet 9, which is secured in place by threaded pin 23 screwed into threaded hole 34 leading into the interior of the rotor. Four detent recesses 35, arranged at angles of 90°, are adapted for the suspension and retention of balls 19.

Referring in further detail to FIGS. 6–10, the inertial mass lock of the rotor has three parallel bores 27 and 27', slidably receiving piston 24 and lock pins 38 and 39. Transversely to these bores is ball race bore 37. Lock pins 38 and 39 hold piston 24 in the locked state whereby rotation of the pellet holder is prevented and it is maintained in the inactivated position. Conical part 25 of piston 24 and tips 38' and 39' of lock pins 38 and 39 engage in corresponding bores 27'' of the housing 7 in the locked position. The lock pins 38 and 39 are biased into the locked position at their ends 38'' and 39'' by the springs 40 and 41. A secure mechanical contact is provided by the balls 42 held in position by lock pins 38 and 39 in recessed portion 26 of piston 24.

The mode of operation of the inertial mass lock will now be described. In the locked state, i.e. during storage and transportation of the ammunition, the condition shown in FIG. 9 is maintained so that pellet holder 6 cannot be rotated into the armed position. If the ammunition is fired with high acceleration, the acceleration acts immediately on piston 24 and lock pins 38 and 39, so that they assume the position shown in FIG. 10. The unlocked state is thereafter maintained by balls 42 blocking recess of piston 24, thereby preventing it from springing back into the locking position.

The primer pellet holder 6, being rotatable while in the unlocked state shown in FIG. 10, receives a clockwise torque from spring 29. The rotation of the pellet holder is delayed by the retard mechanism, as balls 19 are successively pressed by balance wheel 18 into and out of recesses in ball rim 20, whereby the balance wheel executes an oscillating escapement movement. A predetermined delayed rotary movement of pellet holder 6 is thus provided in accordance with the desired time needed for fore-barrel safety. The delay time required may range from a few milliseconds to several seconds, depending on the projectile, the design of the retard mechanism, and the needs of the particular use.

The safety device, shown in FIGS. 1 to 3, is physically independent of the initial unlocking and rotary movement of the pellet holder 6. It now controls the rotation of the pellet holder from the unlocked to the armed position in response to the acceleration behavior of the projectile in flight. In accordance with a principal feature of the invention, a conical shape is preferably provided for bore 1 and for the rotation-symmetrical bolt 2. By a selected cone angle in the range from 10° to 30°, preferably 15°, an undesired jamming of the bolt is prevented in the event of substantial transverse acceleration behavior in flight.

By the selection of the material and size of bolt 2 and of spring 8, the arming operation of bolt 2 with respect to pellet holder 6 can be predetermined within wide limits. In FIG. 11, the rotation-symmetrical bolt 2 with its spring 8 is shown on a coordinate system with the angle formed between the direction of the main acceleration $b_N$ and the instantaneous direction of the projectile being designated by alpha ($\alpha$).

The diagram of FIG. 12 shows the relationship, for arming the projectile, between acceleration values as multiples n of the normal acceleration of gravity g and the angle $\alpha$ for certain materials. The materials shown are aluminum, designated Al (density=2.7 g/cc), steel, St (density=7.8 g/cc) and Reconit, Re (trademark of Gueggi AG, Grenchen, Switzerland, for an alloy consisting of 92.5 per cent W, 7.5 per cent Ni/Cr/Cu, density=18 g/cc). As indicated, a projectile can be safely armed by this invention even under extreme transverse acceleration conditions. Furthermore, the invention can be integrated almost universally into projectiles using existing electrical priming systems. For cylindrical housing 7, the outside dimensions can be of the order of 20 mm diameter and length.

Figure 13:
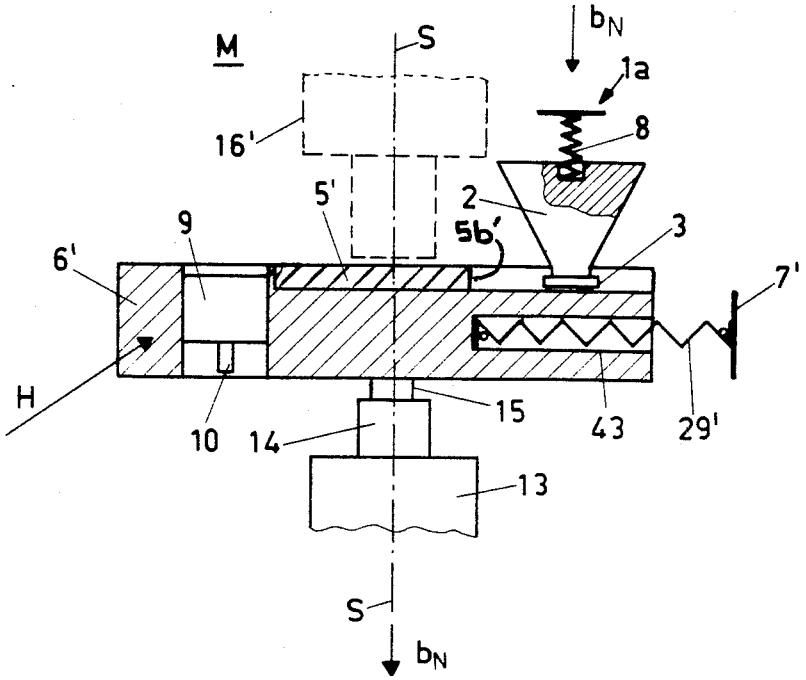
FIG. 13 is a schematic cross-sectional view of another embodiment having a primer pellet holder in the form of a transverse slide.

In FIG. 13 another embodiment of the invention is shown in simplified form. This employs a slide type primer pellet holder equipped with the described safety device. Axis of symmetry S indicates the direction of main acceleration $b_N$. Slide type primer pellet holder 6' is arranged normal to axis S and has primer pellet 9 with pole pin 10 (shown in the unarmed position), V-track groove 5', and blind-hole bore 43. In bore 43, arming or extension spring 29' is fastened between the holder and housing 7'. A safety device, identical with that of FIG. 1, projects into groove 5' and is biased forwardly by spring 8 secured by threaded ring 1*a*.

At the front of the projectile is electrical charge generator 13 with telescoping contact 14 applied to pellet holder 6'. On the opposite side is booster charge 16' at a small distance from pellet holder 6'. The retard mechanism is symbolized by arrow H and acts at one end of the pellet holder.

The mode of operation of this device is analagous to that described previously. The acceleration forces acting on bolt 2 move projecting flange 3 out of groove 5'. Arming spring 29' pulls the slide toward the armed position, where pole pin 10 of primer pellet 9 is in electrical contact with telescoping contact 14. Upon target impact, primer pellet 9 ignites and detonates booster charge 16' in a known manner. If the acceleration forces are interrupted or are abnormal, bolt 2 is moved forward to re-engage flange 3 in groove 5', so as to lock and prevent continued movement of the pellet holder toward the armed position.

Figure 14:
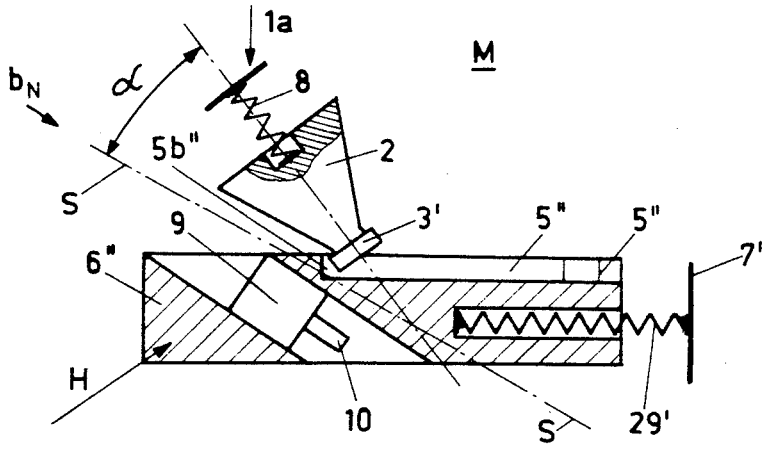
FIG. 14 is a schematic cross-sectional view of another embodiment having the pellet holder in the form of a slide oriented at one angle to the direction of acceleration, and the bolt of the safety device oriented at another angle thereto.

The embodiment shown in FIG. 14 is constructed analogously to that of FIG. 13, except that, to reduce the space requirement, bolt 2 is arranged at an angle to axis of symmetry S of projectile M. To insure safe detonation of the booster charge, primer pellet 9 is installed in pellet holder 6'' obliquely; i.e. oriented in the direction of the axis of symmetry S. Projecting flange 3' of bolt 2 is formed like a pawl so as to be engageable with locking face 5*b*'' of groove 5'' of pellet holder 6''. The selection of the angle of the bolt 2 to the axis S can be optimized, for example, with the aid of the diagram of FIG. 12, for an expected range of dynamic flight behavior of the projectile when fired.

The described embodiments of the invention provide a high degree of safety and reliability in cases in which, due to its trajectory and/or its firing behavior, the projectile has relatively high transverse accelerations. It excels moreover by its simplicity, small overall size, and ability to be integrated into existing as well as newly devised priming systems. The safety device is also effective to prevent accidental movement of the rotor, for example during storage or handling, since the spring will maintain the bolt in the unarmed position.

As previously noted, the invention has been designed particularly for use with the rotary and slide type pellet holders. While only certain preferred forms of my invention have been described, it will be clear to those skilled in the art that various changes and modifications can be made, for example, by the use of the equivalent materials, components, or sequences of operation. All such modifications are intended to be included within the scope of my invention which is to be broadly construed and not to be limited except by the character of the claims appended hereto.

I claim:

1. A safety device for releasibly preventing undesired movement of a primer pellet holder in a housing of a projectile from an unarmed to an armed position, comprising a groove along an edge of a pellet holder having a locking member at one end thereof, a bore in the housing intersecting said groove of the pellet holder, said bore having a longitudinal axis parallel to an expected direction of acceleration of the projectile and being conical over at least a part of its length, a bolt slideably mounted for longitudinal movement in said bore, said bolt having a corresponding conical shape over at least a part of its length such that the bolt is capable of transverse as well as well as longitudinal movement in said bore, whereby said bolt remains operable under acceleration forces that are transverse to the expected direction of acceleration, said bolt further having a projection at one end thereof for projecting into said groove for engagement with said locking member at the end of said groove to maintain the pellet holder in an unarmed position, and means normally urging said bolt into said groove, said bolt being movable against the force of said urging means to remove the projection from said groove and release the pellet holder to the armed position in response to the expected acceleration forces upon firing of said projectile.

2. The safety device of claim 1 wherein said urging means is a spring centered in an end of the bolt opposite from the projection.

3. The safety device of claim 1, wherein the bore has a cylindrical zone adjacent said projection for accomodating longitudinal movement of said projection.

4. The safety device of claim 1 wherein the projection is a flange having a plane surface perpendicular to the direction of main acceleration of the projectile.

5. The safety device of claim 1, wherein the primer pellet holder is a rotor, wherein said groove extends over a part of its periphery, and said projection extends into said groove tangentially when the device is to be maintained in the unarmed position.

6. The safety device of claim 1 wherein the primer pellet holder is a slide.

7. The safety device of claim 1 further comprising a retard mechanism connected to said pellet holder for delaying movement of said pellet holder toward the armed position for a predetermined time.

8. The safety device of claim 6 wherein the primer pellet holder is transverse to the axis of main acceleration, and the bolt is arranged in alignment with the axis of main acceleration.

9. The safety device of claim 6 wherein the primer pellet holder is transverse to the axis of main acceleration, and the bolt is at an angle to the axis of main acceleration.

10. The safety device of claim 5 further comprising an arming spring for rotating said rotor from the unarmed position to the armed position.

* * * * *